United States Patent [19]

Morgan et al.

[11] 4,372,561

[45] Feb. 8, 1983

[54] VOLLEYBALL PRACTICE APPARATUS

[75] Inventors: Steven R. Morgan, Ogallala; Linda A. Carlson, North Platte, both of Nebr.

[73] Assignee: Volleyball World, Inc., Ogallala, Nebr.

[21] Appl. No.: 303,847

[22] Filed: Sep. 21, 1981

[51] Int. Cl.[3] ..... A63B 69/22

[52] U.S. Cl. ..... 273/411; 273/58 C; 273/413

[58] Field of Search ..... 273/411, 413, 58 C, 273/29 A, 26 E

[56] References Cited

U.S. PATENT DOCUMENTS

| | | | |
|---|---|---|---|
| 861,506 | 7/1907 | Doyle | 273/58 C X |
| 3,351,343 | 11/1967 | Papp | 273/58 C X |
| 4,027,880 | 6/1977 | Hadtke | 273/58 C X |
| 4,147,353 | 4/1979 | Moore | 273/413 |

*Primary Examiner*—William H. Grieb

*Attorney, Agent, or Firm*—Shanley, O'Neil & Baker

[57] ABSTRACT

Volleyball practice apparatus especially useful in training players in spiking the ball includes a lightweight, flexible support harness closely engaging and confining a volleyball, and a pair of flexible, elastically extensible lines having one end attached to the harness and their other end attached one to each of a pair of upwardly extending supports adjustably mounted on a lightweight structural frame adapted to be attached to the volleyball net to support the volleyball above and to one side of the net in position for spiking. The elastically extensible support lines permit the ball to be projected down and across the net in substantially the same manner as in spiking a free ball. The extensible lines then return the ball upward and back across the net into position to be spiked again.

15 Claims, 6 Drawing Figures

FIG. 1
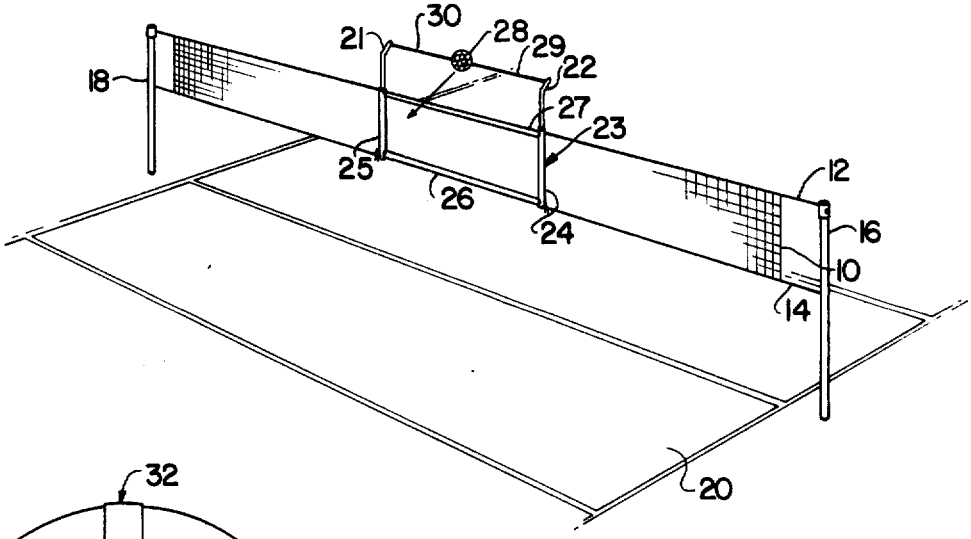
FIG. 2
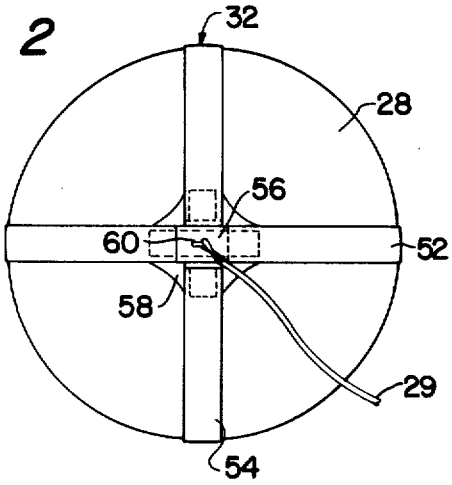
FIG. 3
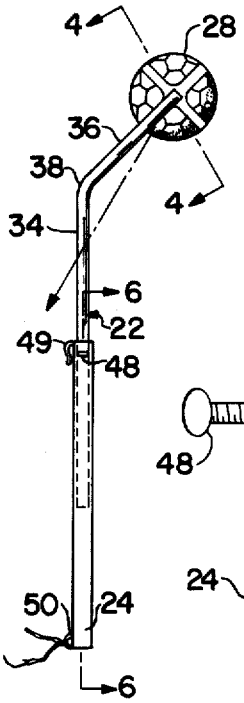
FIG. 4
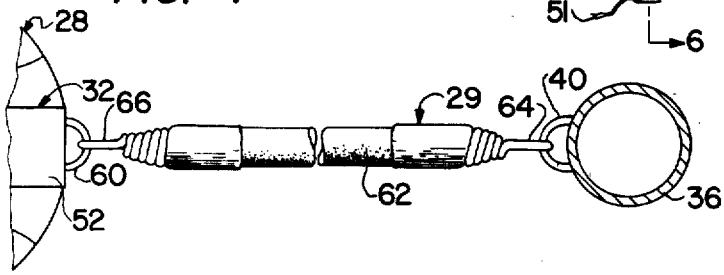
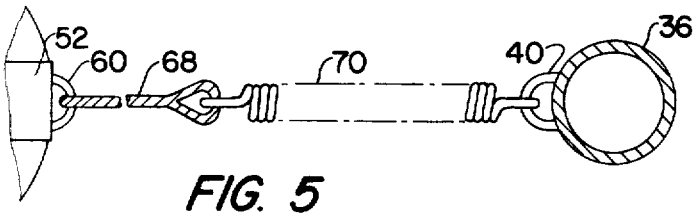
FIG. 5
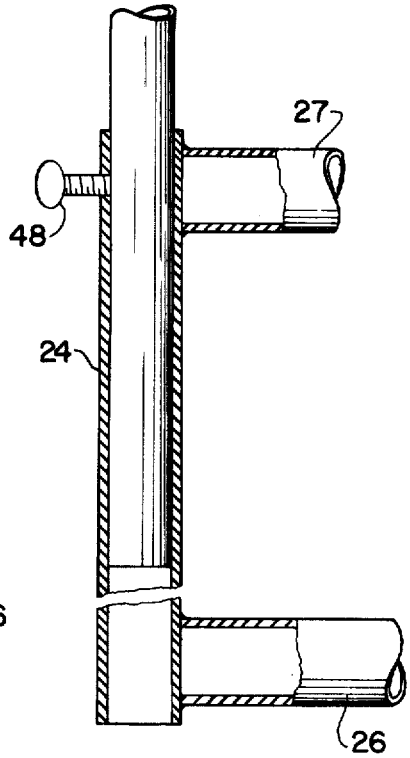
FIG. 6

VOLLEYBALL PRACTICE APPARATUS

BACKGROUND OF THE INVENTION

1. Field of the Invention

This invention relates to volleyball practice apparatus, and more particularly to an improved apparatus to enable the practice of spiking a volleyball and of defending against a spiked volleyball.

2. Description of the Prior Art

In the sport of volleyball, the well executed spike is a highly effective play. However, the experienced player can defend against the spike which is not well executed so that the result may be exactly the opposite intended by the person attempting the spike. It is, therefore, important for the well-trained and skillful player to spend a great deal of time practicing the spiking play. In the past, at least one other person, usually a teammate or coach was employed to set the ball for each player practicing the spiking play, and preferably a second person was employed across the net in position to defend against the play to more closely simulate actual competition. Additional time was required in collecting the spiked balls.

In an effort to utilize player practice time more efficiently, devices have been developed to position, or hold a ball stationary above and to one side of the net, and one such device is shown, for example, in U.S. Pat. No. 3,897,950. In this device, a vertically adjustable standard is positioned adjacent the net and has a pair of arm members supported with their free ends in opposing relation to one another. Resilient spongelike members mounted on the ends of the arms are provided to support a volleyball to be spiked. When the ball is struck in a simulated spike, the resilient arms deflect to permit the ball to pass through and to avoid injury to the hand and arm of the person spiking the ball. This patent also discloses a rebounding frame structure adapted to be positioned adjacent the net to simulate the action of a spiked ball being returned by an opposing team member to permit practice of this aspect of the game.

While the volleyball training apparatus of the above-mentioned patent, and the similar apparatus disclosed in the U.S. Pat. No. 4,022,471, enables spiking practice by a single player, the apparatus has many apparent defects as a training aid. First, it is necessary to physically position a ball on the resilient pads at the ends of the support arms each time the ball is to be spiked. Further, spiking a completely stationary ball does not adequately simulate conditions encountered in the volleyball game to enable the player to achieve the desired skill by practicing with such apparatus.

SUMMARY OF THE INVENTION

It is the primary object of the present invention to provide an improved volleyball practice apparatus which enables players to practice spiking the ball without requiring the assistance of additional players or coaching personnel.

Another object of the invention is to provide an improved volleyball practice apparatus for enabling the practice of spiking the ball under conditions simulating those encountered in actual play.

Another object of the invention is to provide such a volleyball practice apparatus which enables a number of players to practice spiking the ball in succession to obtain maximum utilization of player practice time.

In the attainment of the foregoing and other objects and advantages of the invention, an important feature resides in providing elastically extensible cord means extending generally parallel to the top of a volleyball net to support a volleyball above and to one side of the net in position to be spiked. The elastically extensible cord means permits the ball to be spiked across the net, and provides sufficient retraction force to return the ball, on rebound, back across the net in position to be again played or spiked. A soft, flexible bridle or harness closely confines the ball, with the cord means being attached to the bridle and to adjustable supports projecting upward from a frame releasably attached to the net. The resilience of the cord means is selected to provide the desired movement of the ball to more closely simulate actual movement of a ball in play.

BRIEF DESCRIPTION OF THE DRAWINGS

The foregoing and other objects and advantages of the invention will be apparent from the detailed description contained hereinbelow, taken with the drawings, in which:

FIG. 1 is a perspective view of a volleyball practice device according to the present invention installed on a volleyball court;

FIG. 2 is an enlarged view of a portion of the structure shown in FIG. 1 and illustrating the means for confining the volleyball in the apparatus;

FIG. 3 is an enlarged end elevation view of the apparatus shown in FIG. 1;

FIG. 4 is an enlarged, fragmentary sectional view taken in, line 4—4 showing further details of the volleyball support means;

FIG. 5 is a view similar to FIG. 4 and showing an alternative embodiment; and FIG. 6 is an enlarged fragmentary sectional view taken on line 6—6 of FIG. 3.

DESCRIPTION OF THE PREFERRED EMBODIMENT

Referring now to the drawings in detail, a conventional volleyball net 10 is illustrated in FIG. 1 as being secured by suitable cords or cables 12, 14 to a pair of vertical support posts 16, 18 located one on each side of a volleyball court designated generally by the reference numeral 20. The support posts 16 and 18 are of standard height and are located outboard of the playing court in accordance with conventional practice. Such support posts are conventionally metal tubular members, or pipes, rigidly anchored in the ground in the case of outdoor courts, or having means for rigidly securing the post to the floor in indoor courts.

The volleyball practice apparatus according to the present invention is intended to be used with the conventional apparatus described above to enable one or more persons to practice spiking the ball and/or defending against such spiking play. As illustrated in FIG. 1, the apparatus includes a pair of support arms 21, 22, respectively, mounted in and projecting upwardly from the ends of a rectangular frame structure 23. Frame 23 is an open rectangular structure made up of a pair of spaced vertically extending tubular end members 24, 25 and a pair of spaced, horizontal members 26, 27 as best seen in FIG. 6. Horizontal members 26, 27 have their ends rigidly joined to the vertical members as by welding. Preferably members 26, 27 are also tubular to provide a relatively rigid yet lightweight frame.

A standard volleyball 28 is supported between the top end portions of support arms 21, 22 by a pair of flexible, elastically extensible lines 29, 30 and a ball harness assembly 32 best seen in FIG. 2.

Support arms 21 and 22 are identical and accordingly only the arm 22 will be described in detail, it being understood that the description also applies to arm 21. Thus, support arm 22 includes a lower, vertically extending leg portion 34, and an inclined leg portion 36, with the two leg portions being joined at a substantially 45° angle as indicated at 38 in FIG. 3. A rigid eyelet 40 is mounted on leg portion 36 adjacent its top end to provide a convenient means for securing one end of the elastically extensible line 38.

The vertical leg portion 34 of arm 22 is telescopingly received in the open top end of vertical frame member 24 and adjustably supported therein by a set screw 48 best seen in FIG. 6. Thus, the arms 21, 22 may be easily adjusted both vertically and rotationally by simply loosening the set screws 48, then retightening them after the adjustment has been comcpleted.

The frame 23 is adapted to be supported on the volleyball net 10 so that rigid standards and the like are not required. To enable the frame to be quickly and easily attached and removed from the net, a pair of hook-shaped, downwardly open clips 49 are provided one adjacent the top of frame members 24 and 25, respectively. Clips 49 are adapted to hook over and receive top net cable 12 to support the frame in position with the arms 21, 22 projecting above the net. To stabilize the frame, a pair of eyelets 50 are provided, one adjacent the bottom of each frame member 24, 25, and flexible ties, or cords, 51 are provided to secure the eyelets 50 to the bottom net cord 14. Preferably the eyelets and clips are spaced apart a distance which is slightly less than the normal spacing of net cords 12, 14 so that a light tensile force in ties 62 will tend to hold the frame 23 in an upright position.

Referring to FIG. 2, it is seen that the volleyball 28 is securely confined, or caged, in the harness assembly 32 which is made up of a pair of relatively thin, flexible endless belts, or straps 52, 54 each positioned to encircle the volleyball. The straps 52, 54 are arranged to cross one another at substantially right angles and are secured together by suitable means such as stitching illustrated at 56. Also, a thin flexible gusset member 58 is stitched to the straps 52, 54 at their intersection to reinforce the joint and to provide stability against the strap members being displaced relative to one another around the surface of the volleyball. While only one gusset 58 and one point of intersection of the straps 52, 54 are shown, it is understood that a second gusset would be used at the other point of intersection diametrically opposed to the one illustrated.

A flexible attachment loop, or eyelet 60 is secured to the harness at each point of intersection of the straps 52, 54, with one of the eyelets being shown in FIGS. 2, 4 and 5. The eyelets 60 provide means for attaching the elastically extensible lines 29, 30 which support the voleyball 28 caged in the harness between the support arms 21, 22 as shown in FIG. 1.

The elastically extensible cords 29 and 30 are preferably substantially identical and accordingly only cord 29 will be described with reference to FIG. 4. Thus, the cord 29 includes an elongated elastic body portion 62 having hook members 64, 66 permanently attached to its opposed ends. Hooks 64, 66 are adapted to engage the rigid eyelet 40 on support standard 22 and the flexible loop 60 on the harness 32. Although rigid hook members are illustrated in FIG. 4 it is understood that other means may also be provided to secure the cord to the support standard and the harness to the ball in the central position supported above and to one side of the net as shown in FIG. 3. The elastic body portion 62 may be of any suitable commercially available material. For example, the central portion of the cord may comprise a plurality of strands of rubberlike material retained by an outer, extensible braided casing. Alternatively, as shown in FIG. 5, a relatively thin high strength flexible cord member 68 may have one end attached to the loop 60 and its other end attached to a longitudinally extensible member such as a coil spring 70 which, in turn, is attached to the rigid eyelet 40 on support 22. Regardless of specific structure of the cords 29 to 30, it is preferable that they be of relatively lightweight construction so as to provide minimum interference with the normal movements of the volleyball 28 except for the constraining action provided by the tensile force in the respective cords.

Since the upper leg portions 36 of the support arms 21, 22 are inclined, the position of a volleyball supported between the two arms relative to the net may be varied by rotating the arms about the vertical axes of the vertical frame members 24, 25 and the support leg portions 34. Thus, with the arms 21, 22 being disposed in planes which are substantially perpendicular to the net 10, and with the inclined leg portions 36 being inclined in the same general direction, the volleyball 28 will be spaced at its maximum distance from the net. To move the ball closer, in its position of rest, the arms may be rotated about the vertical axes of the vertical frame members. Rotations of the two support arms in the same direction, i.e. clockwise or counterclockwise, will result in moving the ball relative to the net without changing the tensile force in the elastic cords. Conversely, rotating the two support arms in opposite directions may result in increasing or decreasing, as desired, the tensile force. Raising or lowering the ball relative to the net is accomplished simply by raising or lowering the respective arms.

From the above description, it is believed apparent that the volleyball practice apparatus according to the present invention provides a relatively inexpensive, simple means enabling the practice of spiking the ball and which avoids many of the drawbacks of the prior art devices. Thus, the elastic support cords will return the ball, after it has been spiked, to enable repeated spiking or playing the ball under realistic, game simulating conditions. Further, the apparatus may be employed by a single player or by multiple players as desired.

While preferred embodiments of the apparatus have been disclosed, it is believed apparent that various modifications may readily be made. For example, the upper inclined leg portion 36 of the support arms may be longitudinally extensible, utilizing a simple telescoping means such as that illustrated in FIG. 6 to mount the arms. Thus, while we have disclosed preferred embodiments of our invention, we wish it understood that we do not intend to be restricted solely thereto, but rather that we do intend to include all embodiments thereof which would be apparent to one skilled in the art and which come within the spirit and scope of our invention.

We claim:

1. Volleyball practice apparatus comprising, a pair of upright arms, support means adapted to mount said arms adjacent a volleyball net in spaced apart relation to one another and each having a top end portion spaced above the volleyball net, a pair of elongated cord members each having one end adapted to be secured one to the top end portion of each said arm, flexible harness means adapted to receive and retain a volleyball, said harness means having attachment means associated therewith on substantially diametrically opposed sides of a volleyball received therein, said attachment means being adapted to have the other ends of said cord members attached thereto to support said harness and a volleyball received therein above and spaced from one side of the top of the volleyball net, said cord members being elastically extensible to permit a volleyball supported in said harness to be projected across the net and having sufficient elastic resilience to return the ball back across the net.

2. The volleyball practice apparatus according to claim 1 further comprising height adjustment means operable to permit the height of the arms above the volleyball net to be selectively adjusted.

3. The volleyball practice apparatus according to claim 1 further comprising means for adjusting said arms to adjust the position of a volleyball supported between said arms toward and away from the volleyball net.

4. The volleyball practice apparatus according to claim 1 wherein said flexible harness means comprises a plurality of flexible, endless strap members each adapted to extend circumferentially around and closely engage a volleyball supported in the harness, the endless strap members crossing and being secured to one another.

5. The volleyball practice apparatus according to claim 4 wherein said attachment means comprises a pair of flexible loop members each secured to said flexible strap means at a point where at least two such straps cross one another.

6. The volleyball practice apparatus according to claim 1 wherein said support means comprises a structural frame, and means for releasably mounting said structural frame on a volleyball net whereby the volleyball net supports the volleyball practice apparatus.

7. The volleyball practice apparatus according to claim 1 wherein said cord means comprises a substantially inelastic cord portion and a resilient, elastically extensible portion.

8. The volleyball practice apparatus according to claim 7 wherein said elastically extensible portion comprises a coil spring.

9. The volleyball practice apparatus according to claim 1 comprising means selectively operable to adjust the height of the arms above the volleyball net and the position of a volleyball supported on the standards toward and away from the net.

10. The volleyball practice apparatus according to claim 9 wherein said support means comprises a structural frame, and means for releasably mounting said structural frame on a volleyball net whereby the volleyball net supports the volleyball practice apparatus.

11. The volleyball practice apparatus according to claim 10 wherein said flexible harness means comprises a plurality of flexible, endless strap members each adapted to extend circumferentially around and closely engage a volleyball supported in the harness, the endless straps crossing and being secured to one another.

12. The volleyball practice apparatus according to claim 11 wherein said attachment means comprises a pair of flexible loop members each secured to said flexible strap means at a point where at least two such straps cross one another.

13. The volleyball practice apparatus according to claim 1 further comprising height adjustment means operable to permit the height of the arms above the volleyball net to be selectively adjusted, and wherein said harness means comprises a plurality of flexible, endless strap members each adapted to extend circumferentially around and closely engage a volleyball supported in the harness, the endless straps crossing and being secured to one another.

14. The volleyball practice apparatus according to claim 1 wherein said support means comprises a structural frame, and means for releasably mounting said structural frame on a volleyball net whereby the volleyball net supports the volleyball practice apparatus.

15. The volleyball practice apparatus according to claim 14 wherein said structural frame comprises an open, generally rectangular frame including a pair of laterally spaced, generally vertical tubular members each having an open top end, said arms being mounted one in the open end of each said generally vertical tubular member and being vertically and rotationally movable thereon, said frame further comprising means selectively operable to prevent such vertical and rotational movement.

* * * * *